US005401192A

United States Patent [19]

Briones et al.

[11] Patent Number: 5,401,192

[45] Date of Patent: Mar. 28, 1995

[54] COMBINATION CONNECTOR

[75] Inventors: Francisco R. Briones, Markham; Kamal S. Boutros, Richmond Hill, both of Canada

[73] Assignee: Amphenol Corporation, Wallingford, Conn.

[21] Appl. No.: 219,161

[22] Filed: Mar. 28, 1994

[51] Int. Cl.[6] ..... H01R 13/658

[52] U.S. Cl. ..... 439/639; 439/607; 439/620

[58] Field of Search ..... 439/638, 639, 540, 607, 439/701, 535, 95, 101

[56] References Cited

U.S. PATENT DOCUMENTS

| | | | |
|---|---|---|---|
| 3,879,103 | 4/1975 | Peltola et al. | 439/581 |
| 3,980,382 | 9/1976 | Reeder | 439/581 |
| 4,412,717 | 11/1983 | Monroe | 439/582 |
| 4,500,159 | 2/1985 | Briones et al. | 439/607 |
| 4,618,207 | 10/1986 | Silbernagel | 439/676 |
| 4,629,266 | 12/1986 | Viselli | 439/81 |
| 4,690,479 | 9/1987 | Hollyday et al. | 439/97 |
| 4,695,105 | 9/1987 | Ney et al. | 439/95 |
| 4,695,115 | 9/1987 | Talend | 439/76 |
| 4,712,849 | 12/1987 | Seidel et al. | 439/607 |
| 4,726,638 | 2/1988 | Farrar et al. | 439/620 R |
| 4,772,224 | 9/1988 | Talend | 439/607 |
| 4,795,352 | 1/1989 | Capp et al. | 439/63 |
| 4,799,901 | 1/1989 | Pirc | 439/620 |
| 4,804,332 | 2/1989 | Pirc | 439/620 |
| 4,842,529 | 6/1989 | Frantz et al. | 439/95 |
| 4,850,902 | 7/1989 | Reed | 439/676 |
| 4,884,982 | 12/1989 | Fleming et al. | 439/620 |
| 4,923,310 | 5/1990 | Sekiguchi et al. | 439/701 |
| 5,057,041 | 10/1991 | Yu et al. | 439/620 |
| 5,062,811 | 11/1991 | Hackman | 439/620 |
| 5,073,123 | 12/1991 | Birch et al. | 439/188 |
| 5,083,945 | 1/1992 | Miskin et al. | 439/607 |
| 5,102,354 | 4/1992 | Crane et al. | 439/620 |
| 5,108,300 | 4/1992 | Weber | 439/188 |
| 5,125,854 | 6/1992 | Bassler et al. | 439/607 |
| 5,143,868 | 9/1992 | Caveney et al. | 439/638 |
| 5,145,412 | 9/1992 | Tan et al. | 439/620 |
| 5,158,480 | 10/1992 | Blondeel et al. | 439/607 |
| 5,167,536 | 12/1992 | Wang | 439/620 |
| 5,192,228 | 3/1993 | Collins et al. | 439/607 |
| 5,207,597 | 5/1993 | Kline | 439/607 |
| 5,288,246 | 2/1994 | Whiteman, Jr. et al. | 439/540 |
| 5,290,175 | 3/1994 | Robinson et al. | 439/540 |
| 5,326,280 | 7/1994 | Briones et al. | 439/581 |

FOREIGN PATENT DOCUMENTS

| | | | |
|---|---|---|---|
| 4000934 | 8/1990 | Germany | 439/639 |
| 53-86387 | 7/1978 | Japan . | |
| 2169156 | 7/1986 | United Kingdom . | |

OTHER PUBLICATIONS

National Tel-Tronics product brochure "The New Wave in Coaxial Connectors".

*Primary Examiner*—Gary F. Paumen
*Attorney, Agent, or Firm*—Bacon & Thomas

[57] ABSTRACT

In order to save space and reduce the number of parts needed to mount a plurality of connector types on a circuit board, the different connector type share a common molded housing, and at least two of the connector types share a common shield which includes an integral board lock and which can also be arranged to facilitate mounting filter components in one, or more of the connector types. The connector types may include a BNC coaxial cable connector, a modular phone jack connector, and a multiple pin D-sub connector, with the BNC and modular jack connector sharing the common shield.

6 Claims, 1 Drawing Sheet

COMBINATION CONNECTOR

BACKGROUND OF THE INVENTION

1. Field of the Invention

This invention relates to electrical connectors, and in particular to electrical connectors of the type used to couple data communications cables with circuitry on a circuit card.

2. Description of Related Art

The need for cables and connectors capable of transferring data between computers and peripherals has increased exponentially in recent years as the advantages of networked systems of personal computers, and access to the so-called information highway, have become increasingly evident to users. Despite the increasing popularity of modem communications and networked computer systems, however, and the corresponding tendency towards standardization of system components, there currently exists a wide variety of different cable and connector types, with none likely to attain exclusivity in the foreseeable future. The different cable types currently in widespread use include twisted pair cables and coaxial cables for serial communications, and numerous different multiple wire configurations for parallel communications.

Although each different cable type requires a different connector, the use of separate interface cards for each type of cable or connector is unnecessarily redundant, and thus it is common to provide more than one type of connector on a single card in order to enable the card to communicate with compatible devices which differ only in the choice of cable or connector required. The Ethernet network interface, for example, can interchangeably use all three of the above-mentioned types of cable and thus, in order to provide compatibility with a maximum number of external devices, it is common to provide as many as three different types of connectors on a single Ethernet interface or adapter card.

In general, twisted pair cables are coupled to a network or data communications interface via connectors of the type popularly referred to as modular phone jack connectors because of their resemblance to the standard four wire telephone jack connector. This type of connector is commonly denoted by the letters RJ, followed by a numerical indicator (e.g., the RJ 45 connector often used in Ethernet applications). An example of a state-of-the-art modular jack connector with advanced filtering capabilities is found, for example, in copending U.S. patent application Ser. No. 08/043,544.

Coaxial cable connections are usually accomplished by a type of connector known as the BNC connector, filtered examples of which are shown in copending U.S. patent application Ser. No. 08/075,876.

Multiple wire cables, on the other hand, in general utilize a variety of different multiple pin connectors, including mini-DIN connectors and D-sub connectors such as the RS-232 standard 25 pin (DB25) connector, and the 15 pin (DB15) connector commonly used in Ethernet cards. Depending on the specific needs of the user, these connectors may be either shielded or unshielded, and may or may not include filter components such as capacitors.

Fortunately for interface card manufacturers, three of the most common types of connectors-modular jack connectors, BNC connectors, and D-sub parallel connectors-are all small enough to fit side-by-side on a standard network card. Nevertheless, for reasons which were not previously appreciated by those skilled in the art, placement of the three standard connectors on a card without modification is a less than optimal configuration.

The first reason is that the total width of the connectors arranged on the card often determines the minimum width of the card itself. Even though this minimum width may be acceptable from the standpoint of compatibility with available slots in the device within which the card is to be used, it turns out that minimizing the card even further than necessary due to space considerations is highly desirable because the width of the card can gave a significant effect on cost, with even small decreases resulting in significant savings in materials costs. This savings results from the fact that, due to decreases in the costs of circuitry on the card, the material of the circuit board itself has become significant. It turns out that printed circuit board materials presently cost approximately $.12 per square inch. This is a very high cost when one considers the volume of cards sold and the overall price of each card, and thus it would be very desirable to reduce the size of the card as much as possible. A reduction in width of one half inch for a typical eight inch interface card could save almost $.50 in material costs per card.

The second reason is that the provision of three connectors on a card results in redundancies, previously unrecognized, which could be eliminated by sharing certain components between connectors, in particular housings, shielding, and the board locks used to mount the connectors; on the card.

SUMMARY OF THE INVENTION

It is accordingly a first object of the invention to provide a connector configuration for a circuit board or card which requires less space than conventional configurations.

It is a second objective of the invention to provide a connector configuration for a circuit card in which redundancy is eliminated by sharing components between the connectors.

It is a third objective of the invention to provide a combined modular jack, BNC, and D-sub connector for use on a circuit card, which requires less space than standard configurations and which eliminates redundancies.

It is a fourth objective of the invention to provide a single connector configuration for a circuit card capable of providing modular phone jack, BNC and D-sub connections, both shielded and unshielded, with or without filtering.

These objectives are accomplished, in a preferred embodiment of the invention by providing a combined modular phone jack, BNC, and multiple pin connector having a single molded housing, a common shield for the BNC and modular phone jack portions of the combined connector, and at least one integral board lock. This design not only has the advantage of using less space and less parts, but also has the advantage of requiring fewer and simpler assembly steps than are required for separate assembly of the three individual types of connectors as currently configured.

BRIEF DESCRIPTION OF THE DRAWING

The lone FIGURE is a perspective view of a connector constructed in accordance with the principles of a preferred embodiment of the invention.

DETAILED DESCRIPTION OF THE PREFERRED EMBODIMENT

Figure 1:
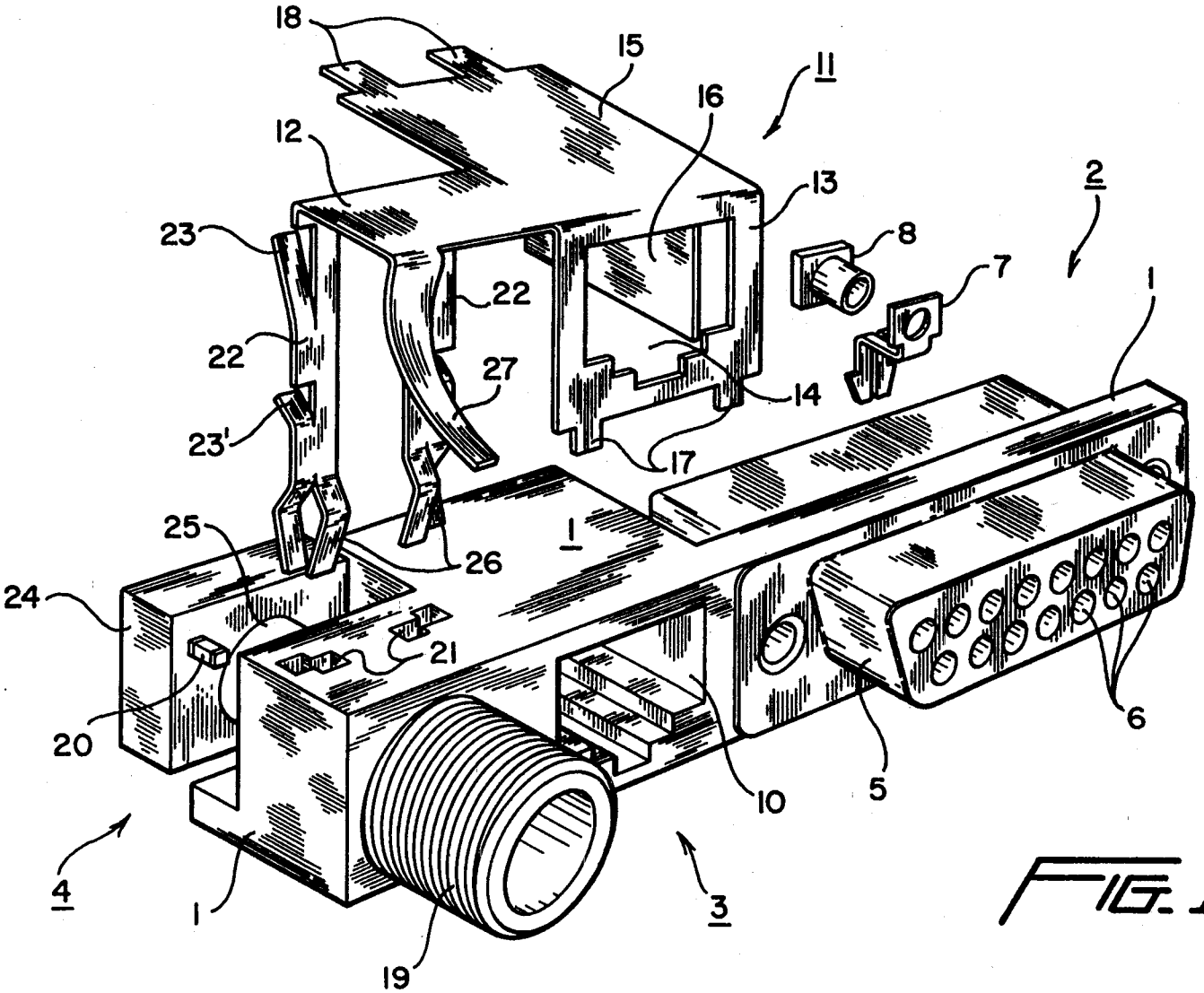

As shown in the FIGURE, the connector of the preferred embodiment includes a combined housing 1 having a D-sub housing section 2, a modular jack housing section 3, and a BNC housing section 4. The shared housing 1 is preferably molded from a suitable plastic, in which case the housing can easily be made in a variety of configurations for different connector types, the illustrated types being typical of a network interface card.

The D-sub section 2 of the preferred connector is conventional in nature, except that its housing is integral with the housing of the modular jack section. Included in this section are a conventional metal shield 5 which surrounds a D-shaped front portion including apertures 6 for receiving correspondingly shaped male or female connector contacts (not shown). Unlike the standard D-sub connector, however, the illustrated D-sub connector section 2 requires only a single board lock 7 for securing the D-sub section on the board. An optional connecting pin 8 for electrically connecting shield 5 with the board lock to provide a ground path therethrough when the board lock is secured to the circuit board may also be provided. Those skilled in the art will recognize that the configuration of the rear portion of the connector section, which is arranged to permit connections between the contacts and the board, is conventional and may be varied according to the specific requirements of the type of D-sub being implemented.

The modular jack section 3 of the connector has a shape identical to the shape of the standard modular jack connector, except that the housing is integrally molded with connector section 2 and 4. The jack receiving aperture 10 in the front of the section, and all internal components (not shown) are identical to those found in conventional jack connectors. The principal departure from conventional connectors in this section of the combination connector is that, instead of a shield case which fits over at least four sides of the housing, a modified shield 11 is provided which is shaped to take into account the fact that only three walls of the section are exposed, and which includes an extension 12 for providing, as will be explained below, grounding in the BNC section 4 of the combination connector.

The portion of shield 11 which covers exposed walls of the modular jack section 3 includes a planar front portion 13 having a cutout 14 corresponding to the aperture 10 in the modular jack, a top portion 15 extending transversely to the front portion 13 which completely covers the top of modular jack section 3, and a single side portion 16 extending transversely to both the top and front portions of section 3, portion 16 being designed to fit between the D-sub connector section 2 and the modular jack section 3. Also included in the illustrated embodiment are pairs of tabs 17 and 18 which can be bent respectively over the bottom and back of the modular jack section to secure the shield on the housing, although those skilled in the art will appreciate that numerous other arrangements for securing the shield on the housing may also be utilized.

Shield 11 includes a lateral extension 12, as noted above, which covers the top of the main body of BNC connector section 4 for use as a ground connection in case the BNC connector is filtered. The filtering arrangement and other aspects of the BNC section, including the shape of a threaded front mating portion 19, are similar to those disclosed in U.S. patent application Ser. No. 08/075,876, and includes filter components, e.g., chip capacitors 20 inserted into slots (not shown) which extend parallel to the direction of the BNC contact and which communicate with vertical passages 21 formed in the connector housing. Lateral extension 12 of shield 11 includes further extensions 22 which fit into passages 21 and which include upper tines 23 and lower tines 23' arranged to extend into corresponding ones of the chip capacitor slots when extensions 13 are inserted into passages 21, thereby biasing any chip capacitors present in the slots against a parallelpiped shaped rear portion 24 of a metal BNC contact 25 of the type disclosed in the above-mentioned application Ser. No. 08/075,876.

Those skilled in the art will appreciate, of course, that while filtering is required for some applications, the filter components may be omitted in others. Nevertheless, because the inclusion of component slots during the housing molding process requires no extra steps, and because mounting of the shield on the connector requires the same number of steps regardless; of whether the filter components are included, the connector preferred embodiment does not need to be modified for either the filtered or unfiltered situation, and the scope of the invention is intended to encompass both situations.

The shield 11 also advantageously includes an integral board lock in the form of bifurcated portions 26 at the distal ends of extensions 22. Bifurcation of the ends of extensions results in the formation of fingers which can bend inwardly upon passage through a hole in a circuit board and then outwardly when the hole is cleared to lock the connector on the board in the manner of conventional board locks, but without the need for an extra piece or assembly step. Also included in the shield is a panel-engaging extension 27 similar to those described in copending patent application Serial Number 08/075,876 for providing a ground path from the shield 11 to a panel on the circuit card or device to which the connector is mounted.

Because the modular jack shield and BNC ground connection are stamped from a single sheet of conductive metal, and because of the shared walls, less metal is required and at the same time a single assembly step suffices to provide both the necessary shielding for both the modular jack and the grounding for the BNC connector. Those skilled in the art will, however, appreciate that numerous variations in the concept of a common shield can be provided, including designs which merely provide a shielding function rather than a filtering function, and designs for various types of connectors other than the three types of connectors shown. As a result of such possible modifications, and others which will undoubtedly occur to those skilled in the art, it is intended that the invention not be limited by the above description or the attached illustration, but rather that it should be limited solely in accordance with the appended claims.

We claim:

1. A combination connector, comprising:

a BNC connector, a modular jack connector, and a multiple pin connector, each connector having a respective housing section, the housing sections being molded together as one piece to form a single molded housing.

2. A connector as claimed in claim 1, wherein the BNC connector includes means for providing a ground path between components in the connector and a panel to which the BNC connector is mounted, wherein the modular jack connector includes a shielding member, and wherein said grounding means is formed by an extension of said shielding member.

3. A connector as claimed in claim 2, wherein the BNC connector is a filter connector.

4. A connector as claimed in claim 3, wherein the housing includes an opening for a BNC contact, a plurality of component slots extending parallel to an axis of the contact, and a plurality of passages in communication with said slots and extending transversely to the slots, wherein said slots provide means for receiving chip capacitors and said transverse passages provide means for receiving further extensions of said shield extension, said further extensions including tabs for engaging electrodes on said chip capacitors when said chip capacitors are positioned in said slots and for biasing the chip capacitors such that second electrodes of said chip capacitors extend through said slots to engage a portion of the BNC contact, a path thereby being formed which extends from said contact through said components to the further extensions, a main portion of the extension, and thence to said panel upon engagement of the shielding member with the panel.

5. A connector as claimed in claim 4, wherein at least one of said further extensions of the shielding member is bifurcated to form, at a distal end thereof, an integral board lock.

6. A connector as claimed in claim 2, comprising a further extension of said shield extension, said further extension being arranged to extend through a passage in the housing, wherein the further extension is bifurcated to form, at a distal end thereof, an integral board lock.

* * * * *